US007255053B2

(12) United States Patent
Hopper et al.

(10) Patent No.: US 7,255,053 B2
(45) Date of Patent: Aug. 14, 2007

(54) BOAT DECK LOCKER

(75) Inventors: Randy Wayne Hopper, Flippin, AR (US); Bradley G. Garringer, Mountain Home, AR (US); Gary W. Howard, Flippin, AR (US)

(73) Assignee: Wood Manufacturing Company, Flippin, AR (US)

( * ) Notice: Subject to any disclaimer, the term of this patent is extended or adjusted under 35 U.S.C. 154(b) by 43 days.

(21) Appl. No.: 11/202,958

(22) Filed: Aug. 12, 2005

(65) Prior Publication Data

US 2006/0043741 A1 Mar. 2, 2006

Related U.S. Application Data

(60) Provisional application No. 60/601,764, filed on Aug. 13, 2004.

(51) Int. Cl.
*B63B 3/56* (2006.01)
*B63B 3/00* (2006.01)
*B63B 11/00* (2006.01)

(52) U.S. Cl. ..... 114/78; 114/85; 114/116

(58) Field of Classification Search ..... None
See application file for complete search history.

(56) References Cited

U.S. PATENT DOCUMENTS 4,385,580 A * 5/1983 Davidson ..... 114/201 R
5,234,238 A * 8/1993 Takimoto ..... 292/216
5,927,772 A 7/1999 Antonucci et al.
5,975,002 A 11/1999 Rieger
6,048,006 A 4/2000 Antonucci et al.
6,393,879 B1 5/2002 William
6,574,911 B1 6/2003 Hurst et al.
2004/0011266 A1* 1/2004 Rabal ..... 114/201 R

OTHER PUBLICATIONS

Figs. 1-4 from U.S. Appl. No. 11/202,958, filed Aug. 12, 2005 with the legend "Prior Art".

* cited by examiner

*Primary Examiner*—Jesus Sotelo
*Assistant Examiner*—Daniel V. Venne
(74) *Attorney, Agent, or Firm*—Merchant & Gould P.C.

(57) ABSTRACT

A boat having a deck with a deck locker is disclosed herein. The deck locker includes a compartment mounted beneath the deck, and an opening in the deck for accessing the interior of the compartment. The locker also includes a lid for covering the opening in the deck. The locker further includes a latching arrangement for releasably securing the lid in a closed position covering the opening. The latching arrangement includes a striker mounted to the lid and a latching member and actuator mounted offset from the lid.

19 Claims, 15 Drawing Sheets

BOAT DECK LOCKER

CROSS-REFERENCE TO RELATED APPLICATION

This application claims the benefit of U.S. Provisional Patent Application Ser. No. 60/601,764, filed Aug. 13, 2004, which application is incorporated herein by reference in its entirety.

TECHNICAL FIELD

The present invention generally relates to storage lockers for boats.

BACKGROUND

Boats often include lockers for storage, livewells, rod holders and other uses. Often, lockers are formed in the deck of the boat to take advantage of space between the deck and the hull that would otherwise not be used. The lids of deck lockers also serve as part of the deck and must be sturdy enough to support people walking on the deck, as well as preferably protecting the interiors of the lockers from excessive water entry. Lockers can have locking mechanisms to protect against accidental opening of the lids or theft of items stored in the lockers.

Known latches provide secure fastening of lids to deck lockers in a closed position to protect the contents of the locker. However, such latches are mounted to the lid of the locker. Often, the latches are recessed so that they are flush with the lid and present an even deck surface while allowing easy opening of and access into the lockers. While the lid may seal the edges of the opening providing access into the deck locker, the latches include components that extend through the lid thereby providing paths for water that accumulates in the latch recess to enter the interior of the locker. Water within these recesses may also cause the latch itself to become corroded and damaged.

SUMMARY

The present invention relates to a boat locker adapted to reduce entry of water into the locker. In one embodiment, the locker is mounted at the deck of a boat and includes a releasable latching arrangement with an actuator mounted offset from the lid to hold the lid closed.

BRIEF DESCRIPTION OF THE DRAWINGS

The invention may be more completely understood by considering the detailed description of various embodiments of the invention that follows in connection with the accompanying drawings.

Figure 1:
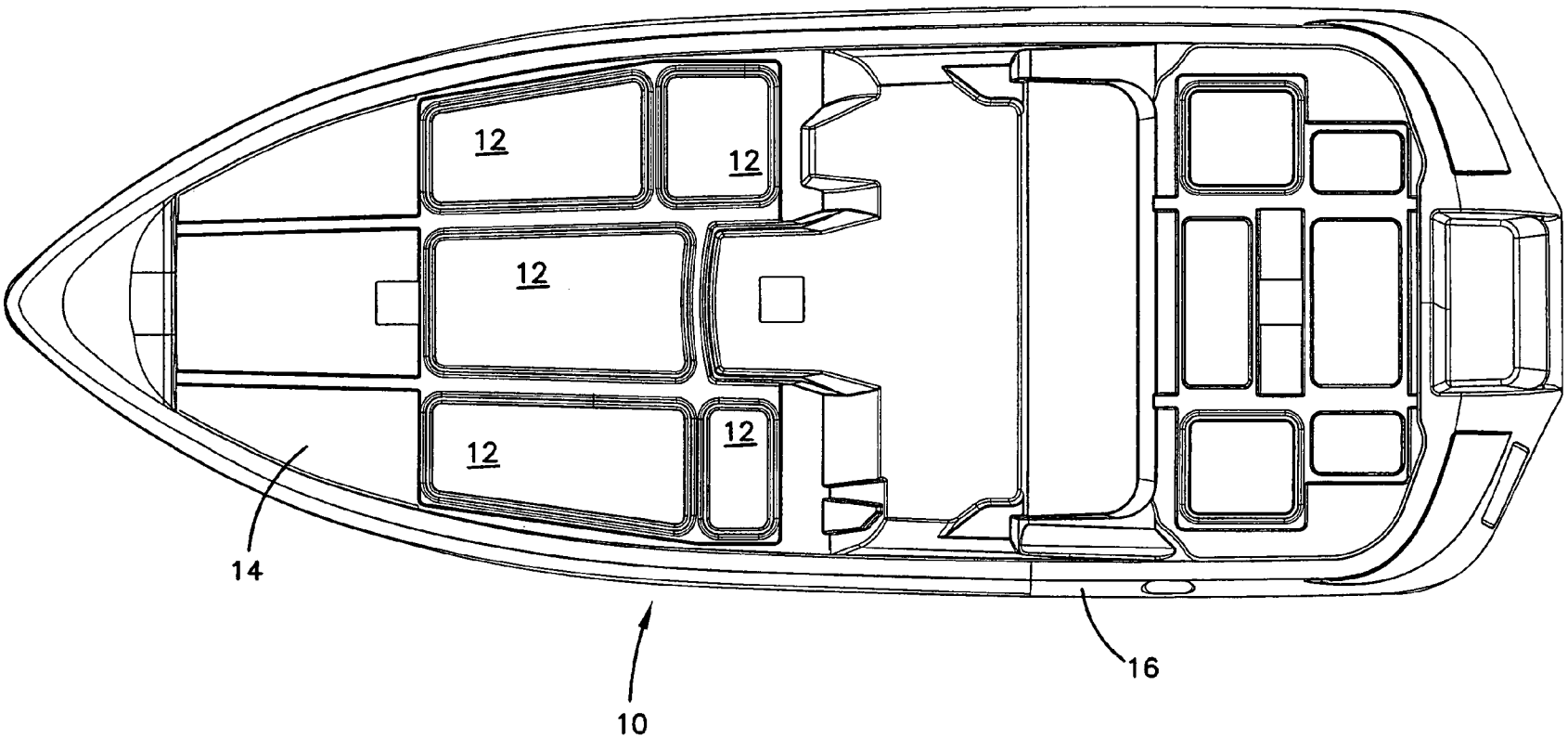
FIG.1 (Prior Art)
FIG. 1 is a top view of a boat including prior art deck compartments, locker lids have been omitted to more clearly show the compartments.

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the invention as defined by the appended claims.

DETAILED DESCRIPTION

In pleasure and fishing boats, such as prior art boat 10 shown in FIG. 1, often a plurality of deck lockers 12 (shown without lids) are included in a deck 14 to take advantage of space between deck 14 and hull 16 for storage. Bulky items such as life jackets, mooring lines, anchors and anchor rode, and other gear may be stored within such lockers 12. Also, some deck lockers 12 may be adapted for storing long or awkwardly sized and shaped items, such as fishing rods and other water sports equipment (skis, wakeboards, etc.) below deck level to keep deck 14 generally free of clutter and provide a safe, secure storage area.

Figure 2:
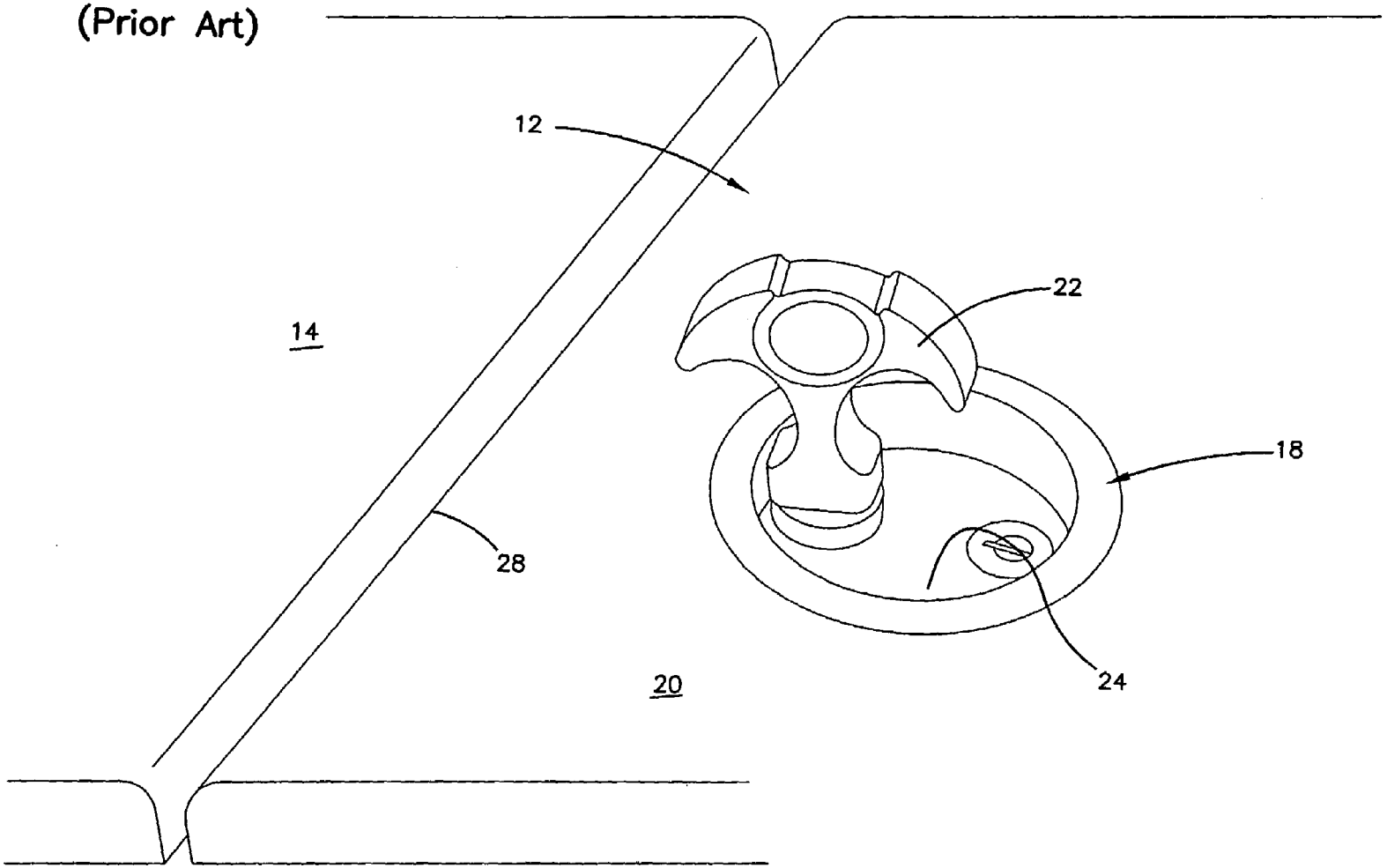
FIG.2 (Prior Art)
FIG. 2 is a top perspective view of a prior art deck compartment latching mechanism installed on a lid adapted to cover one of the deck compartments of FIG. 1.
Figure 3:
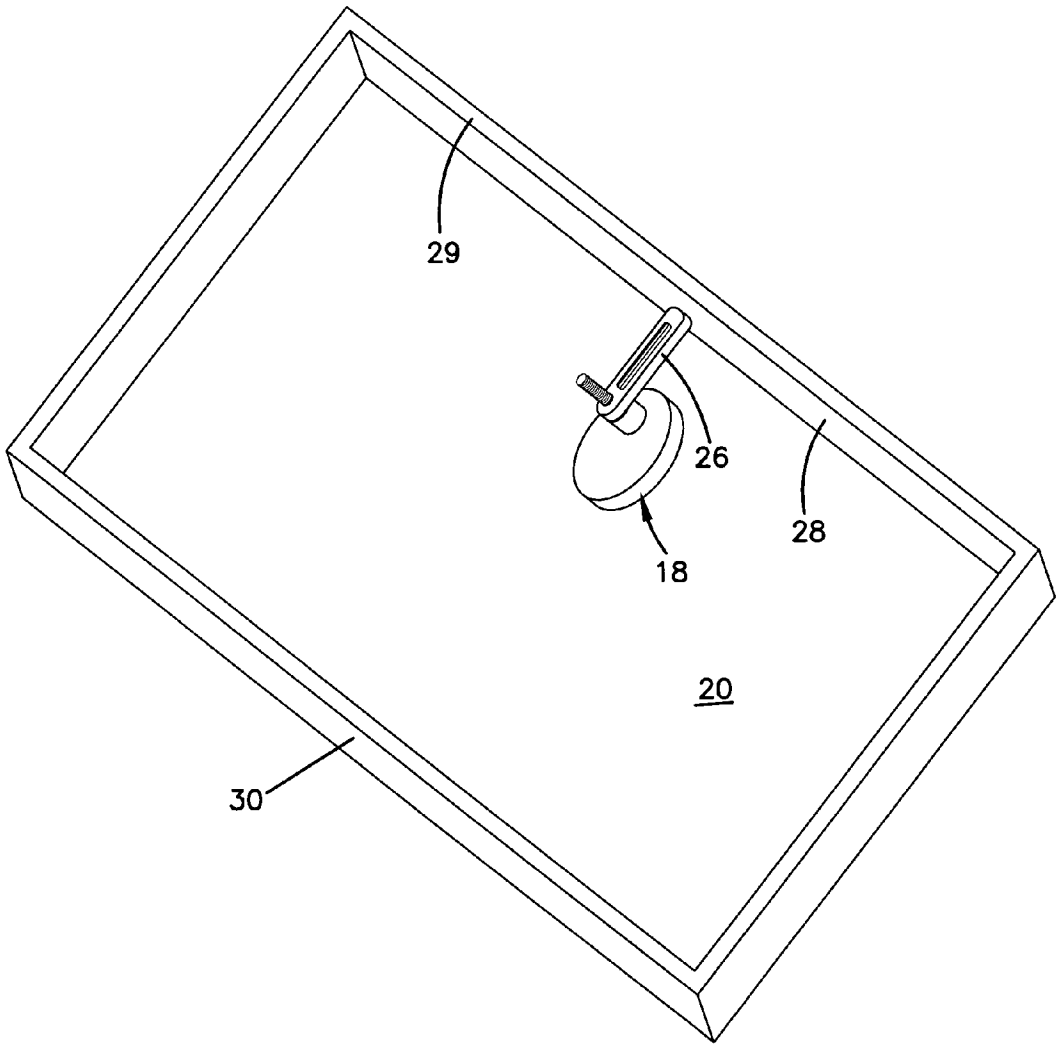
FIG.3 (Prior Art)
FIG. 3 is a bottom perspective view of the lid with the prior art latching mechanism of FIG. 2.
Figure 4:
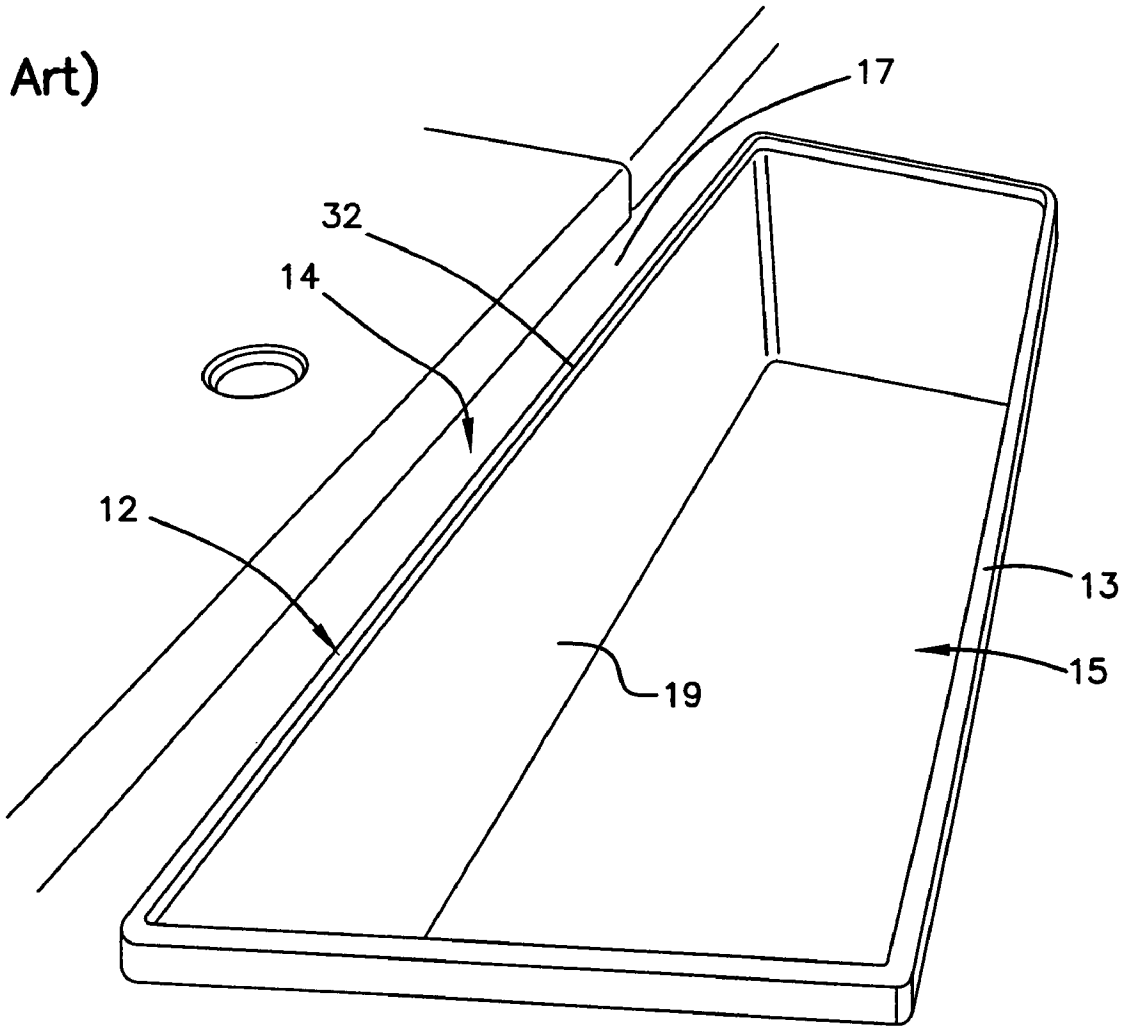
FIG.4 (Prior Art)
FIG. 4 is a top perspective view of a deck locker adapted to be closed by the lid with the prior art latching mechanism of FIG. 2.

FIGS. 2 to 4 show a known latch mechanism 18 for securing a lid 20 adapted to close off one of the deck lockers 12 of FIG. 1. Latch mechanism 18 includes a recessed area 24 in lid 20 with a folding t-handle 22 sized and shaped to fold and fit within recessed area 24 when latched. So folded, t-handle 22 is essentially flush with lid 20. However, t-handle 22 does not fully fill in recessed area 24 when folded, leaving at least a portion of recessed area 24 open for collecting water on deck 14 from spray or splashing, or from rain. T-handle 22 is connected to a cam bar 26 (see FIG. 3) at the inner side of the lid 20 by an arrangement that extends through the lid 20. By rotating the t-handle, the cam bar 26 on the inner surface of lid 20 is moved between a latched and latched position. FIG. 3 shows the orientation of the cam bar 26 when in the latched orientation. As so positioned, the cam bar 26 extends toward a first edge 28 of lid 20. First edge 28 is opposite a second edge 30 along which lid 20 is hingedly mounted to the deck 14.

As shown in FIG. 4, deck locker 12 includes a compartment 19 (e.g., a box or enclosure) beneath the deck. The compartment 19 can be accessed through a top opening 15 defined by a rim or lip 13 that extends about a perimeter of the top opening 15. When the lid 20 is closed, it covers the top opening 15 of the compartment 19. When the t-handle is moved to the latched position while the lid 20 is closed, the cam bar 26 moves beneath lip 13 of the compartment 19 such that the lip 13 is captured between the cam bar 26 and the first edge 28 of lid 20. In this way, cam bar 26 and first edge 28 of lid 20 cooperate to secure lid 20.

When lid 20 is closed, as shown in FIG. 2, lid 20 is flush with the level of deck 14. T-handle 22 is shaped to provide a finger grip to lift lid 20 to open locker 12. Since it is desirable to have lid 20 flush with deck 14, finger grips or other non-retractable protrusions are viable options to aid in opening locker 12. As shown, recessed area 24 in lid 20 is positioned directly above the top opening 15 of the compartment 19 when the lid is closed. Any water splashing or raining on deck 14 may accumulate within recessed area 24. Since the t-handle arrangement extends through the lid, it defines a water intrusion path that allows collected water to drain through latch mechanism 18 into compartment 19 thereby getting items stored within the compartment wet. While seals and other water control devices or techniques may be used to minimize such leakage, latching mechanism must remain movable to permit cam bar 26 to be rotated to unlatch lid 20, and such a movable structure may still be susceptible to leakage.

Referring to FIG. 4, a recessed water channel 17 is provided about the raised lip 13 defining the top opening 15 of the compartment 19. The water channel 17 directs water passing around the edges of lid 20 away from the top opening 15 so that the water does not enter the compartment 19. As shown in FIG. 3, lid 20 includes a lower extension 29 about its perimeter. Lower extension 29 fits about lip 13 and into the water channel 17 to provide a seal against entry of water into compartment 19 through the top opening 15.

Figure 5:
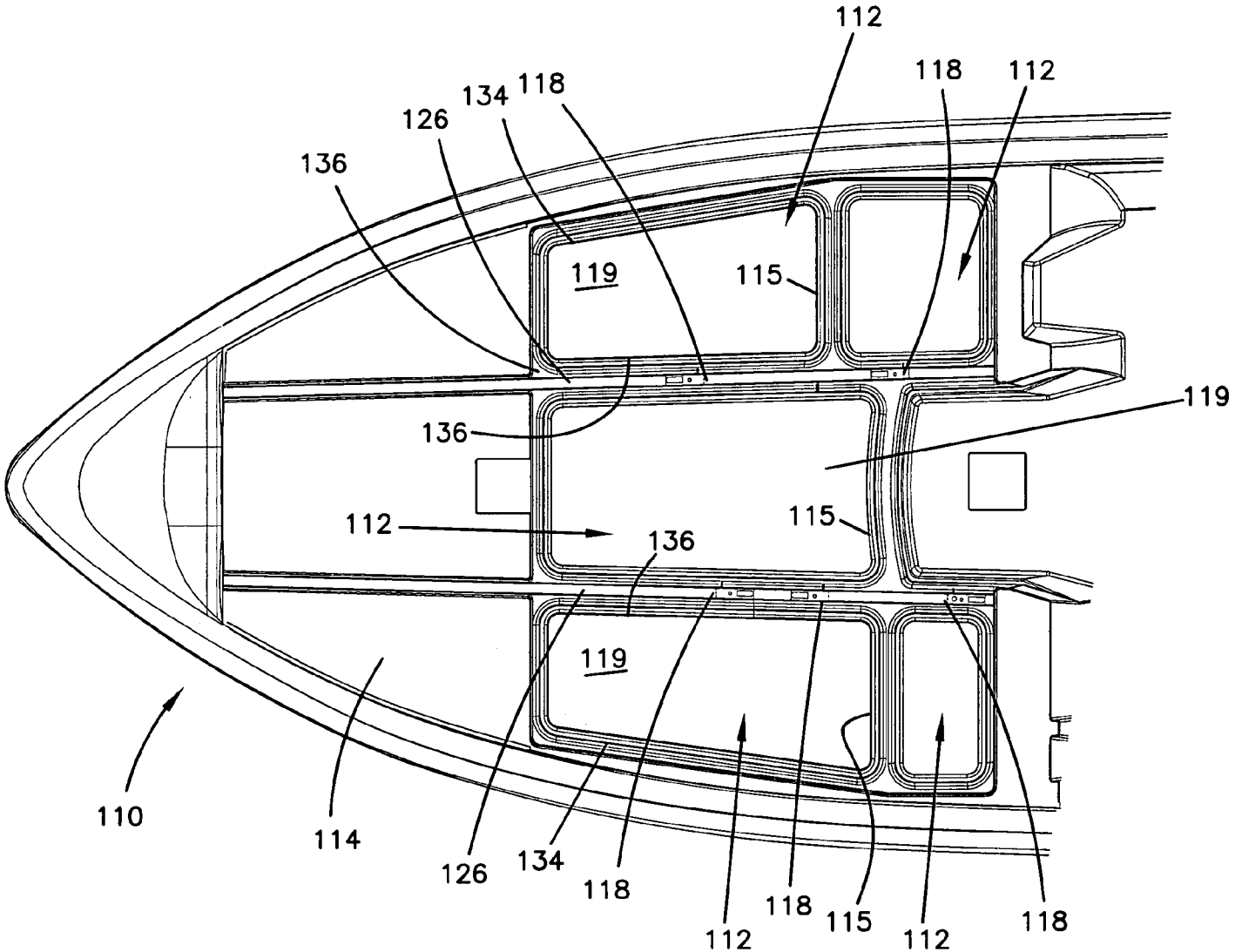
FIG. 5 is a top view of a front portion of a boat including deck compartments of lockers having features that are examples of inventive aspects in accordance with the principles of the present disclosure, lids have been omitted to more clearly show the compartments.
Figure 5A:
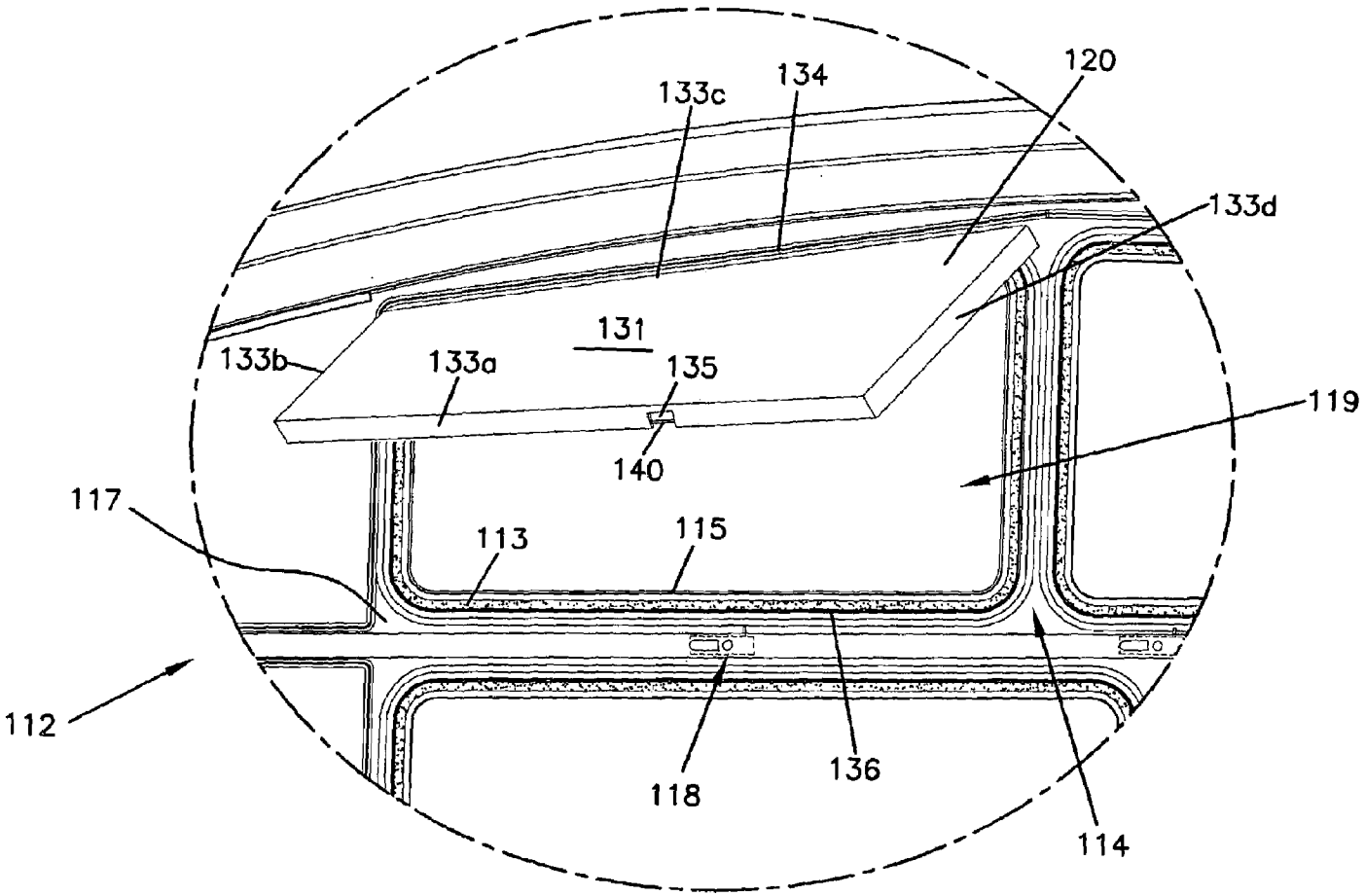
FIG. 5A is a top view of one of the deck lockers of the boat of FIG. 5 equipped with a lid.

FIG. 5 depicts a boat 110 including lockers 112 having features in that are examples of inventive aspects in accordance with the principles of the present disclosure. The lockers 112 are similar in size and function to the deck lockers 12 of prior art boat 10 and include compartments 119 that can be accessed though top openings 115. However, unlike the prior art lockers, the lockers 112 are equipped with latching mechanisms 118 adapted to reduce the likelihood of water intrusion into the lockers 112. For example, the latching mechanisms 118 can include moveable latching members and corresponding actuators that are laterally offset from the top openings 115 when lids of the lockers 112 (an example lid 120 is shown at FIG. 5A) are closed. In certain preferred embodiments, the moveable latches and their corresponding actuators are not mounted on the lids of the lockers, but are instead offset from the lids and configured to engage strikers fixed adjacent the sides of the lids.

Referring to FIG. 5A, the depicted locker 112 includes a storage compartment 119 that can be accessed through a top opening 115 defined by a deck 114 of the boat 110. A raised lip 113 surrounds the perimeter of the top opening 115. In certain embodiments, the raised lip 113 can include a gasket as is conventionally known in the art. A recessed water collection region 117 surrounds the raised lip 113. The locker 112 also includes a lid 120 for opening and closing the top opening 115 of the compartment 119. The lid includes a top surface 131 and outwardly facing side surfaces 133*a-d* that extend downwardly from the top surface 131 of the lid 120. A striker member 140 is mounted to the lid 120 adjacent one of the outwardly facing side surfaces (e.g., side surface 133*a*). As shown at FIGS. 5A, 7, 9 and 10, the lid 120 can include a depression or notch 135 adjacent the side surface 133*a* for allowing the striker member 140 to be at least partially recessed relative to the side surface 133*a*. The latching mechanism 118 is adapted to latch the striker member 140 when the lid 120 is closed.

Figure 10:
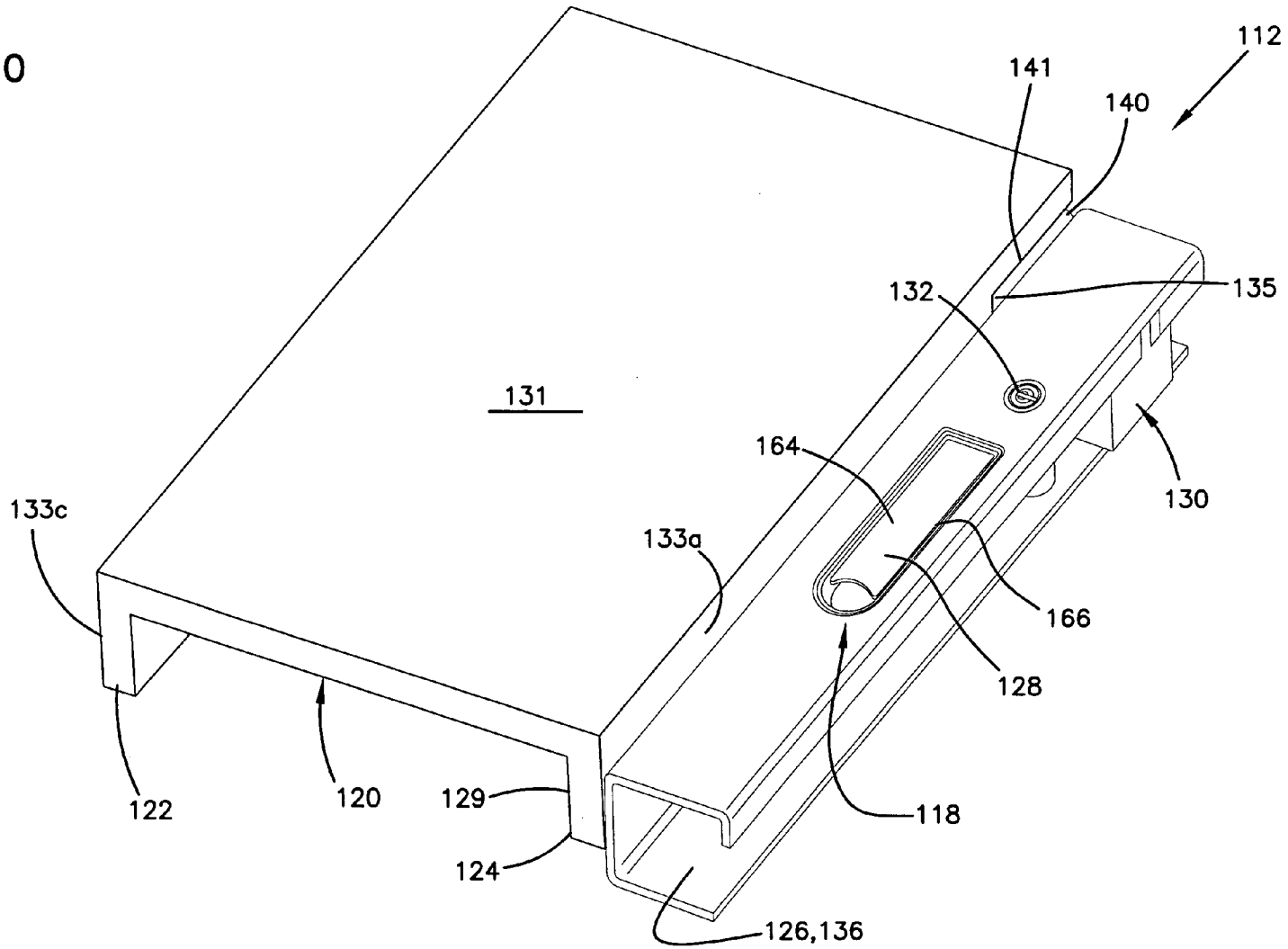
FIG. 10 is another view of the locker of FIG. 9 with the lid partially raised.

Referring to FIGS. 5A and 10, side surface 133*c* is hingedly attached to the deck of the boat adjacent a first side 134 of the top opening 115 of the compartment 119 so that the first side surface 133*a* of lid 120 may be pivoted up and away from a second side 136 of the top opening 115 to open locker 112. A channel 126 having a rectangular cross-sectional shape is positioned adjacent the second side 136 of the top opening 115. Components making up latching mechanism 118 are mounted within the channel 126. By mounting the components of latching mechanism 118 along second side 136 within channel 126, lid 120 may be constructed without a latching mechanism extending through a central portion of lid 120. This reduces the opportunity for water to seep into locker 112.

Figure 6:
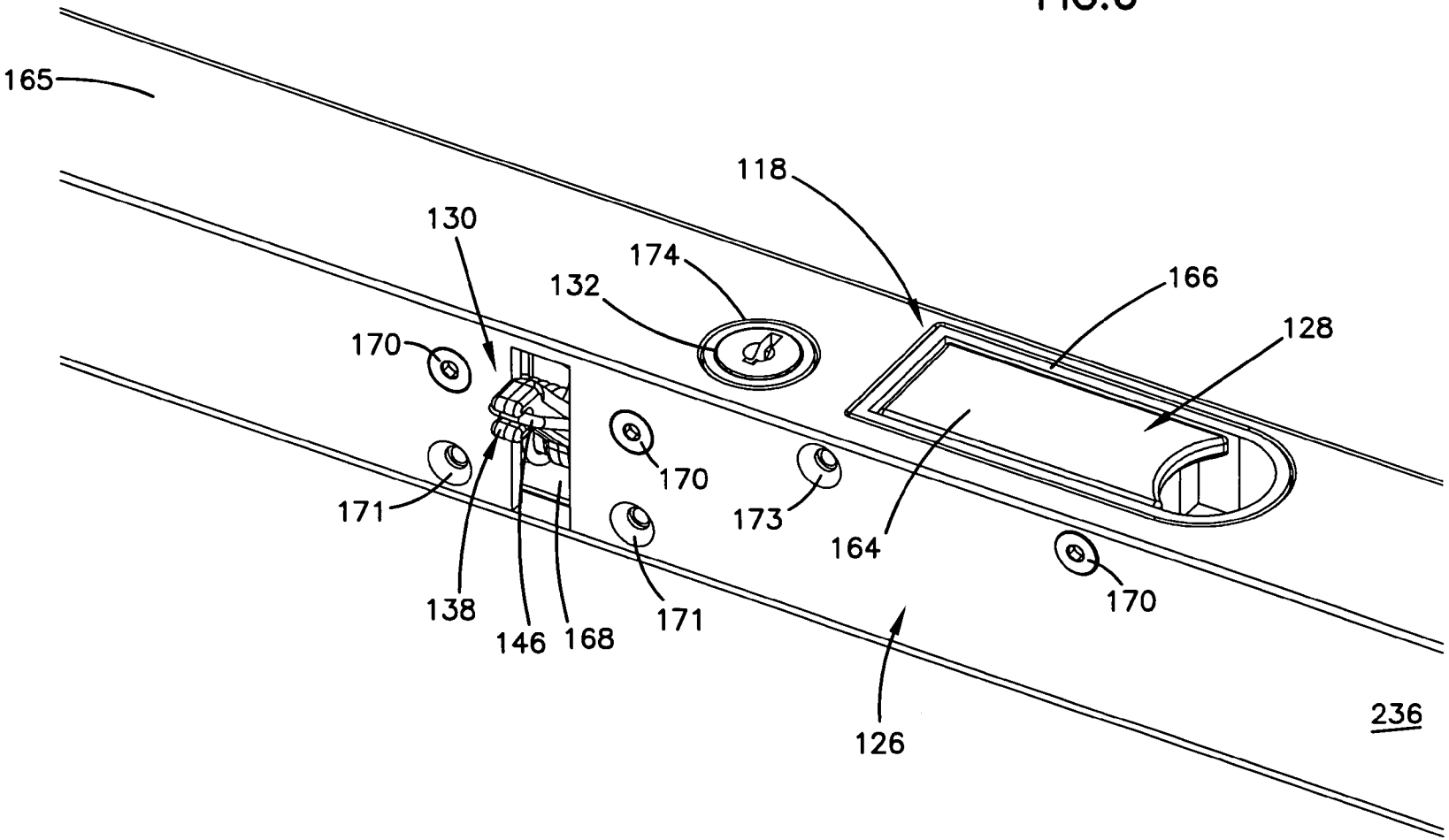
FIG. 6 is a perspective view of a latching mechanism of the deck lockers of FIGS. 5 and 5A.

Referring to FIG. 6, latching mechanism 118 includes an actuator such as a latch handle assembly 128 along with a lid latching assembly 130. A keyed locking cylinder 132 may also be included in the latching mechanism 118 to allow the lid latching assembly 130 to be locked in a latched orientation to prevent undesired access to locker 112. The elements of latching mechanism 118 are described in additional detail below. By mounting the latch handle assembly 128, the lid latching assembly 130 and the keyed locking cylinder 132 within channel 126, any water that may enter the latching mechanism 118 may be directed to the bilge or other area of boat 110 without falling into locker 112.

Latching mechanism 118, latch handle assembly 128, lid latching assembly 130 and keyed locking cylinder 132 are similar in design and function to the ratcheted pawl latch disclosed in U.S. Pat. Nos. 5,927,772 and 6,048,006, the disclosures of which are incorporated herein by reference.

Figure 7:
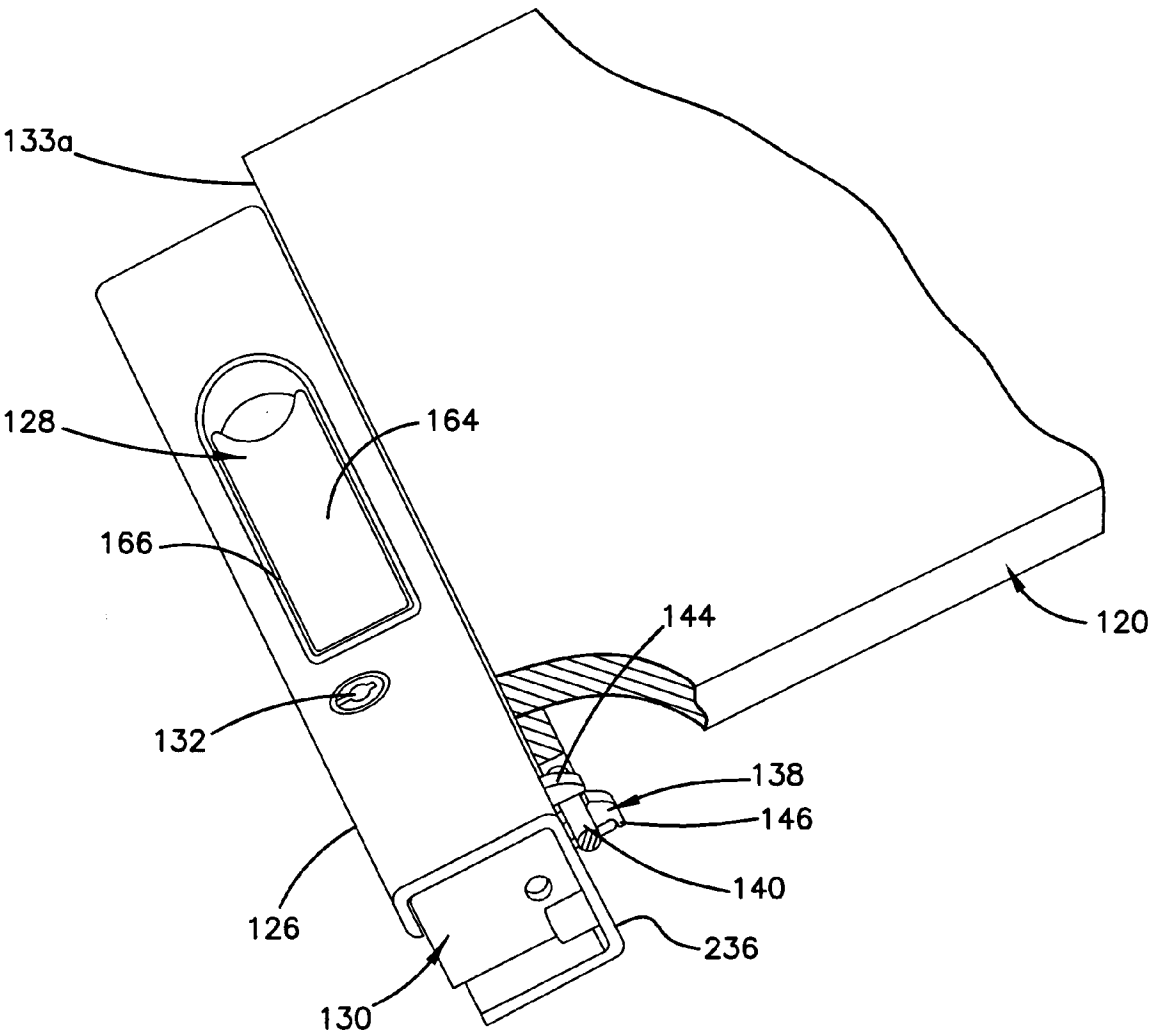
FIG. 7 shows a cut-away view of locker in accordance with the principles of the present disclosure with the lid in a latched configuration.
Figure 8:
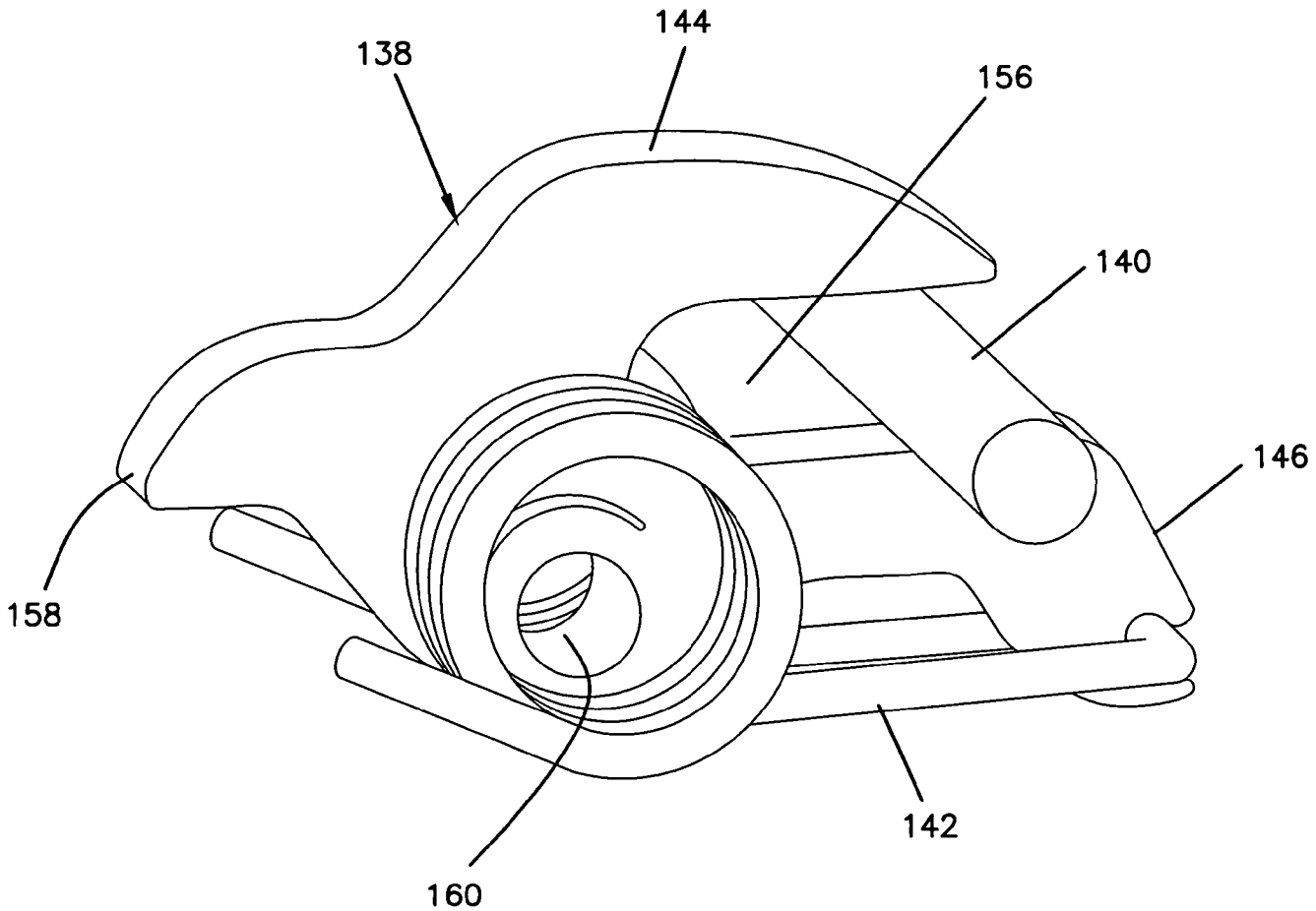
FIG. 8 shows a latching member and striker member of the locker of FIG. 7 in a latched configuration.
Figure 9:
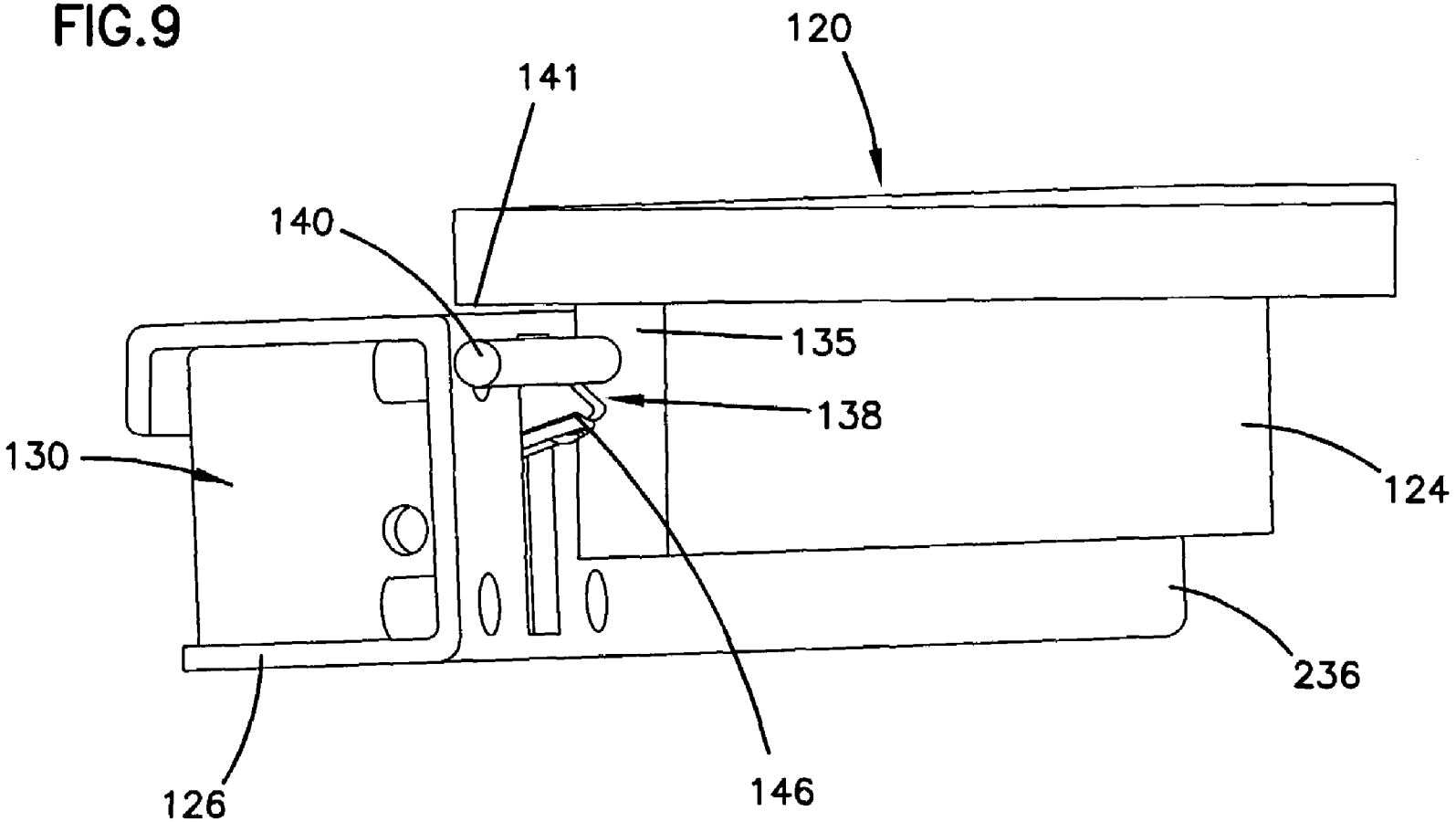
FIG. 9 shows the locker of FIG. 7 with the lid in a non-latched, partially raised configuration.
Figure 11:
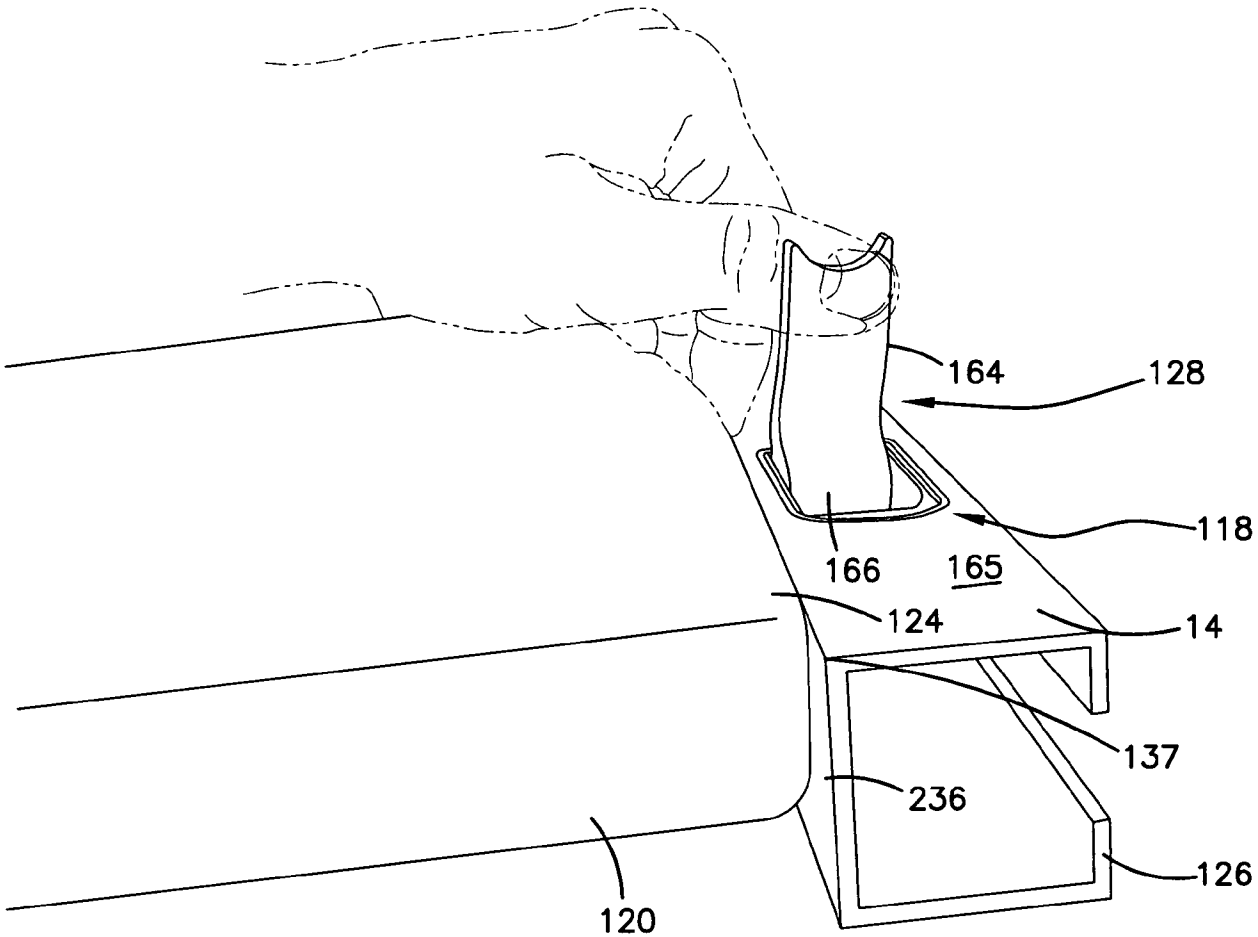
FIG. 11 is still another view of the locker of FIG. 9 with the lid partially raised.

Referring now to FIGS. 6 and 7, lid latching assembly 130 includes a trigger 138 which extends from within channel 126 through a surface 236 and engages the striker member 140 mounted to the side surface 133*a* of lid 120. When the lid 120 is closed, side surface 133*a* of the lid 120 opposes surface 236 of the channel 126. When in a secured position, trigger 138 interacts with striker member 140 to hold lid 120 closed atop locker 112 as shown at FIGS. 7 and 8. When access to locker 112 is desired, actuation of the latch handle assembly 128 will cause trigger 138 to engage striker member 140 and raise the lid 120 at least partially above deck 114 and a top surface 165 of channel 126 as shown at FIGS. 9 and 10. Partially raising lid 120 allows a person wishing to access locker 112 to grasp lid 120 as shown at FIG. 11, and move the lid to an open position. By having latching mechanism 118 provide this operation, no handle is needed to be mounted to lid 120, reducing the avenues through lid 120 for water to follow into locker 112. It is anticipated that latching mechanism 118 will include a spring-loaded trigger 138 so that actuation of the latch handle assembly 128 will initiate trigger 138 to spring upward and raise the lid 120 as shown at FIGS. 9-11. Alternatively, trigger 138 may not include a spring tension device and movement of the latch handle assembly 128 will provide the force to raise lid 120 above channel 126. In certain embodiment, a lip 141 (see FIGS. 9 and 10) can be provided above the recessed striker member 140 to provide improved finger access as shown at FIG. 11.

FIGS. 7 and 8 shows trigger 138 and striker member 140 engaging each other in a latched position. Trigger 138 includes an upper arm 144 and a lower arm 146. A spring 142 is positioned to apply upward pressure to lower arm 146 to rotate trigger 138 about an axis of pivot extending through a pivot opening 160. Upper arm 144 and lower arm 146 define a space 156 between them. When latched, striker member 140 fits within space 156 with lower arm 146 positioned below striker member 140 and upper arm 144 positioned above striker member 140. The upper and lower arms are so positioned to prevent striker member 140 from moving, thus securing lid 120 in place closing off locker 112. Trigger 138 includes a locking member 158 extending opposite the upper and lower arms 144, 146. Locking member 158 engages other portions of latching mechanism 118 to selectively hold trigger 138 in the latching position engaging striker member 140, as shown at FIGS. 7 and 8, or releasing trigger 138 to be rotated by spring 142 to a release position, as shown in FIGS. 9-11.

To open lid 120 of locker 112, with lid 120 secured on locker 112 and trigger 138 engaging striker member 140, a person would grasp and raise an end of a handle 164, which is part of the latch handle assembly 128, as shown in FIG. 6. Handle 164 of the latch handle assembly 128 is accessible through an opening 166 in the top surface 165 of channel 126. Raising handle 164 releases the portion of latching mechanism 118 engaging locking member 158 and permitting force applied to trigger 138 by spring 142 to rotate trigger 138 about the axis of pivot extending through the pivot opening 160. Lower arm 146 of trigger 138 will press upward against striker member 140 and raise lid 120 to the position of FIGS. 9-11. In this position, as shown in FIG. 9, upper arm 144 has been retracted to allow striker member to be removed from space 156 without obstruction. Thus raised, the user will then be able to grasp the edge of the lid 120 and raise lid 120 to allow access to locker 112, as shown in FIG. 11.

To close locker 112 and secure lid 120, the user would allow lid 120 to close far enough so that striker member 140 engages lower arm 146 of trigger 138. In this position, lid 120 will be raised above deck 114. Tension of spring 142 against trigger 138 will act to hold lid 120 in this position without additional closing pressure from the user. Pressing further on lid 120 will cause striker member 140 to depress lower arm 146 and rotate trigger 138 about the axis of pivot extending through the pivot opening 160. As trigger 138 rotates to the secured position, upper arm 144 moves into place atop striker member 140 and striker member 140 is captured within space 156. When trigger 138 is fully depressed by striker member 140, latching mechanism 118 engages locking member 158 and trigger 138 is releasably held in the secured/latched position.

FIG. 6 shows channel 126 including an opening 168 along surface 236 through which trigger 138 extends. Surface 236 also includes fastener openings 171 and 173, and a lock opening 174 in the top surface 165 through which the keyed locking cylinder 132 may be accessed to insert a key to lock or unlock latching mechanism 118. The keyed locking cylinder 132 may be actuated by a key to prevent the latching mechanism from being moved from the latched position to the release position.

As shown in FIGS. 5A and 10, the side surfaces 133*a-d* of lid 120 provide a lower extension 129 about a perimeter of the lid. The lower extension 129 of lid 120 is similar to the lower extension 29 of lid 20, and cooperates with the raised lip 113 and the water collection region 117 to direct water away from entering locker 112. Channel 126, within which latching mechanism 118 is mounted, also provides a conduit for directing water away from entry into locker 112. Any water entering the channel 126, such as through opening 166 or about trigger 138, would be directed away from locker 112, for instance, into a scupper or a drain into a bilge.

Figure 12:
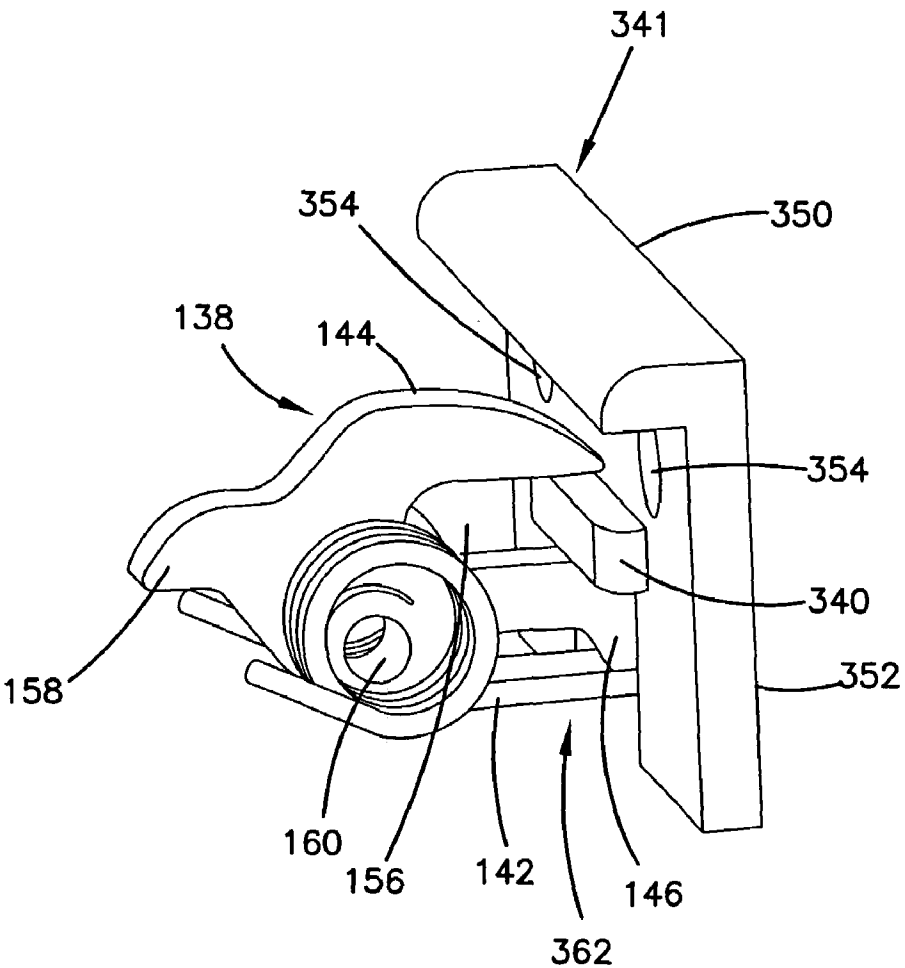
FIG. 12 is a perspective view of an alternative striker member in accordance with the principles of the present disclosure engaging a latching member.

FIG. 12 shows trigger 138 engaging an alternative striker member 341 in a locked position. Trigger 138 includes an upper arm 144 and a lower arm 146. A spring 142 is positioned to apply upward pressure to lower arm 146 to rotate trigger 138 about an axis of pivot extending through a pivot opening 160. Upper arm 144 and lower arm 146 define a space 156 between them. Lower arm 146 is positioned below a ledge 340 (i.e., a striker member) within space 156 and upper arm 144 is positioned above ledge 340. The upper and lower arms are so positioned to prevent ledge 340 of striker member 341 from moving, thus securing lid 120 in place closing off locker 112. Trigger 138 includes a locking member 158 extending opposite the upper and lower arms. Locking member 158 engages other portions of latching mechanism 118 selectively hold trigger 138 in the latching position engaging striker member 341, as shown at FIG. 12, or releasing trigger 138 to be rotated by spring 142 to a release position.

Striker member 341 includes a top edge 350 or lip, which may be mounted flush with or below the upper surface of lid 120, and a mounting wall 352 opposite ledge 340. Mounting wall 352 is positioned against side surface 133*a* of lid 120 and may be secured to lid 120 by fasteners such as screws extending through fastener openings 354, by adhesive, or other fastening methods or a combination fastening methods. Striker member 341 also includes a lower recess 362 extending beneath ledge 340 to permit movement of lower arm 146 to engage and disengage ledge 340.

To open lid 120 of locker 112, with lid 120 secured on locker 112 and trigger 138 engaging striker member 341, a person would grasp and raise an end of a handle 164, which is part of the latch handle assembly 128, as shown in FIG. 6. Handle 164 of the latch handle assembly 128 is accessible through an opening 166 in the top surface 165 of channel 126. Raising handle 164 releases the portion of latching mechanism 118 engaging locking member 158 and permitting force applied to trigger 138 by spring 142 to rotate trigger 138 about the axis of pivot extending through the pivot opening 160. Lower arm 146 of trigger 138 will press upward against ledge 340 of striker member 341 and raise lid 120. Lid 120 will be raised at least partially above the surface of the deck 114. In this position, upper arm 144 has been retracted to permit ledge 340 to be removed from space 156. Thus raised, the user will then be able to grasp the edge of lid 120 or top edge 350 of the striker member 341 and raise lid 120 to allow access to locker 112.

To close locker 112 and secure lid 120, the user would allow lid 120 to close far enough so that ledge 340 of striker member 341 engages lower arm 146 of trigger 138. In this position, lid 120 will be raised above deck 114. Tension of spring 142 against trigger 138 will act to hold lid 120 in this position without additional closing pressure from the user. Pressing further on lid 120 will cause ledge 340 to depress lower arm 146 and rotate trigger 138 about the axis of pivot extending through the pivot opening 160. As trigger 138 rotates to the secured position, upper arm 144 moves into place atop ledge 340 and ledge 340 is captured within space 156. When trigger 138 is fully depressed by ledge 340, latching mechanism 118 engages locking member 158 and trigger 138 is releasably held in the secured position.

Figure 13:
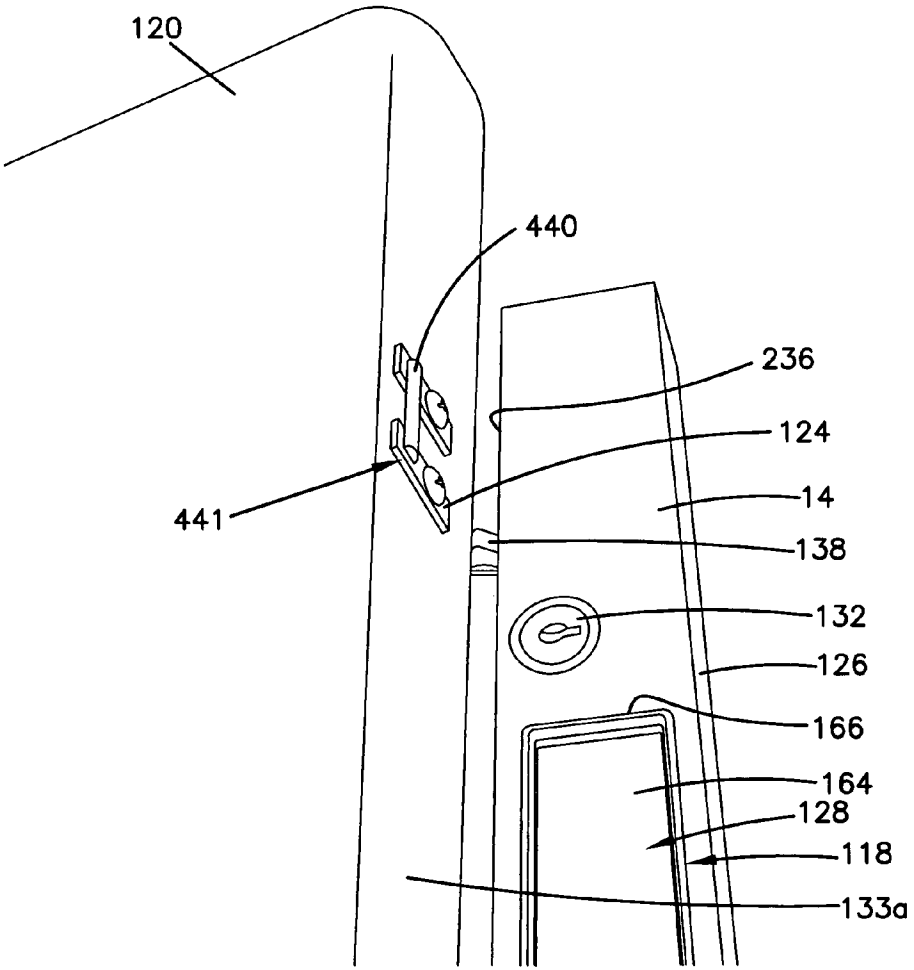
FIG. 13 shows still another striker member in accordance with the principles of the present disclosure mounted at the side surface of a lid.
Figure 14:
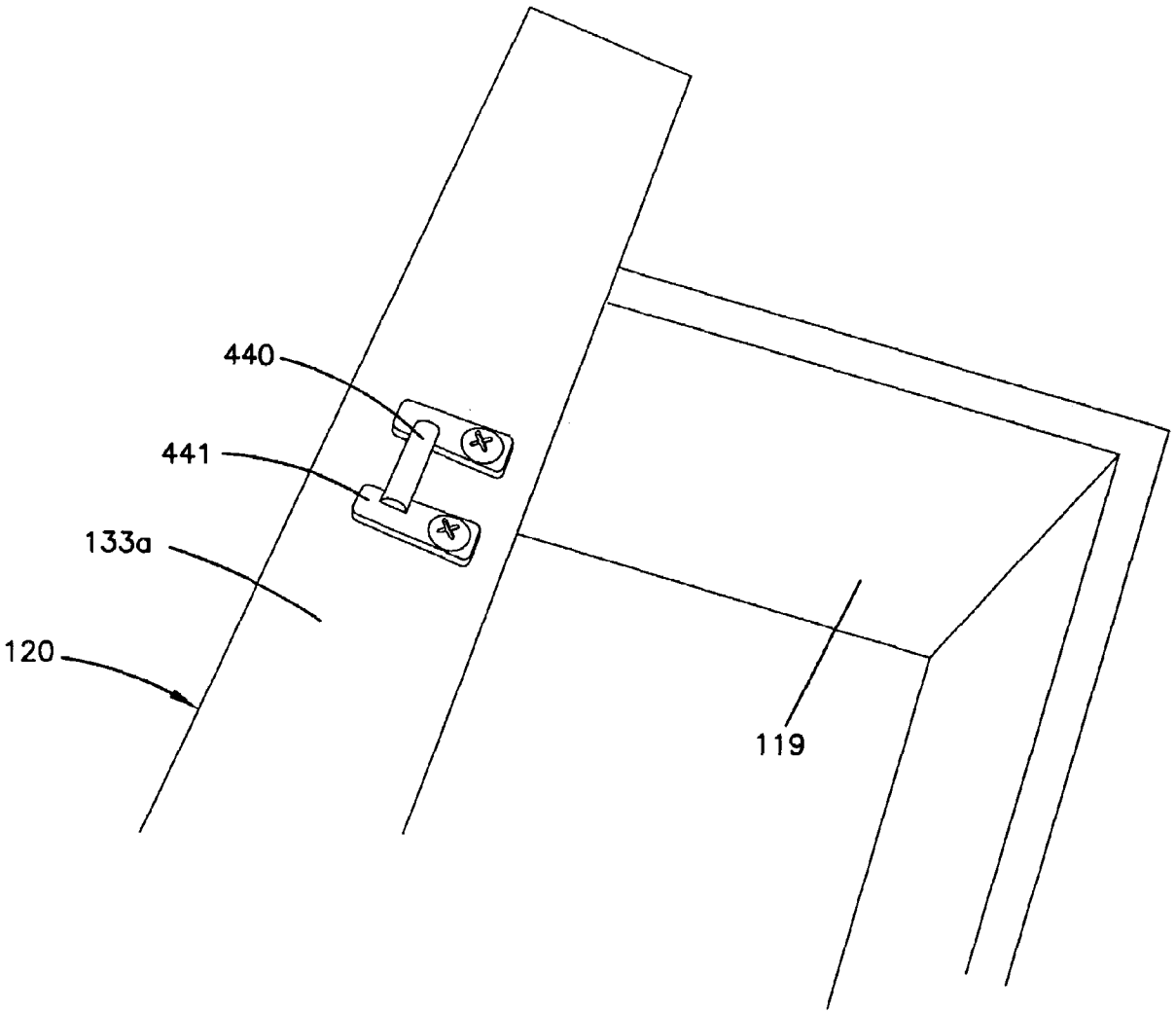
FIG. 14 is another view of the striker member of FIG. 13.

FIGS. 13 and 14 show a further embodiment of a striker member 441 secured to the outwardly facing side surface 133*a* of the lid 120. The striker member 441 includes a striker member 440 that is engaged by the latching mechanism 118, and is not recessed relative to the side surface 133*a*.

The above specification and examples provide a complete description of the manufacture and use of the composition of the invention. Since many embodiments of the invention can be made without departing from the spirit and scope of the invention, the invention resides in the claims hereinafter appended.

What is claimed is:

1. A locker in a deck of a boat comprising:

a lid having a top surface and a side surface extending downwardly from the top surface;

a striker plate mounted to the side surface of the lid;

an opening through the deck having a first side and a second side;

an enclosure beneath the deck;

the lid being hingedly mounted along the first side of the opening, the lid movable between an open and a closed position, the opening configured to be closed by the lid when the lid is in the closed position;

a latching mechanism configured to releasably engage the striker plate of the lid, the latching mechanism being positioned adjacent the second side of the opening, the latching mechanism movable between a latched position engaging the striker plate of the lid and holding the lid in the closed position and a release position; and the latching mechanism mounted within a channel outside the opening adjacent the second side of the opening, the channel having an inner wall that faces toward the opening, the latching mechanism also including a trigger extending through the inner wall of the channel to engage the striker plate of the lid.

2. The locker of claim 1, wherein an edge of the top surface of the lid in the closed position is substantially flush with the deck adjacent the second side of the opening, and wherein the locking mechanism raises the edge of the top surface of the lid above the deck when the latch is moved from the latched position to the release position.

3. The locker of claim 1, wherein a lip surrounds the opening, and the deck defines a water channel that surrounds the lip at a location beneath the lid.

4. The locker of claim 1, further comprising a handle mechanism to actuate the latching mechanism between the latched position and the release position.

5. The locker of claim 1, wherein the channel is incorporated into the deck and provides structural support for the deck adjacent the opening.

6. A locker in the deck of a boat comprising:

a top opening;

an enclosure beneath the top opening;

a lid for covering the top opening having a top surface and a side surface extending downwardly from the top surface;

a latching arrangement for releasably securing the lid in a closed position covering the opening, the latching arrangement including:

a striker mounted to the side surface of the lid;

a latching member for engaging the striker to secure the lid in the closed position;

an actuator for releasing the latching member from the striker to allow the lid to be opened; and the actuator and the latching member being offset from the lid.

7. The locker of claim 6, wherein the striker is mounted to an edge of the side surface of the lid.

8. The locker of claim 6, wherein the actuator is mounted in a channel along a side of the top opening.

9. The locker of claim 8, wherein the channel drains beneath the deck into a bilge of the boat.

10. The locker of claim 6, wherein the striker includes a striker member that is at least partially recessed relative to the side surface of the lid.

11. The locker of claim 6, wherein the striker includes a striker member that is not recessed relative to the side surface of the lid.

12. The locker of claim 10, wherein the lid includes a notched region at the side surface, and the striker member is at least partially recessed within the notched region.

13. The locker of claim 12, further comprising a lip positioned above the notched region.

14. A boat comprising:

a deck;

a locker provided at the deck, the locker including:

a compartment positioned beneath the deck;

a top opening for accessing the compartment;

a raised lip surrounding the opening;

a lid moveable between a closed position where the top opening of the locker is covered and an open position where the top opening is not covered, the lid having a top surface and an outwardly facing side surface that extends downwardly from the top surface;

a striker member mounted to the side surface of the lid; and a latching member movable between a latching position and a non-latching position, the latching member being adapted to engage the striker member when in the latched position to prevent the lid from being opened, the latching member allowing the lid to be opened when in the non-latching position, the latching member being mounted so as to not be carried by the lid when the lid is moved between the open and closed positions.

15. The boat of claim 14, further comprising an actuator for moving the latching member from the latching position to the non-latching position, the actuator being located at a location offset from the lid.

16. The boat of claim 15, further comprising a channel mounted to the deck, wherein the top opening of the locker includes a first side positioned opposite from a second side, wherein the lid is hingedly connected to the deck adjacent the first side of the top opening of the locker, wherein a portion of the channel extends along the second side of the top opening of the locker, and wherein the actuator and the latching member are at least partially mounted within the portion of the channel that extends along the second side of the top opening.

17. The boat of claim 15, wherein the top surface of the lid is flush with the deck when the lid is latched closed, and wherein the latching member lifts the lid to a non-flush orientation with respect to the deck when the actuator is actuated.

18. The boat of claim 14, wherein the striker member is at least partially recessed relative to the side surface of the lid.

19. The boat of claim 14, wherein the striker member is part of a striker plate having a top lip positioned above the striker member and adapted to mount substantially flush with the top side of the lid.

* * * * *